United States Patent [19]

Grieben

[11] Patent Number: 4,577,644

[45] Date of Patent: Mar. 25, 1986

[54] APPARATUS FOR TIP TURNING FILTER CIGARETTES OR THE LIKE

[75] Inventor: Karl-Heinz Grieben, Schwarzenbek, Fed. Rep. of Germany

[73] Assignee: Hauni-Werke Körber & Co. KG, Hamburg, Fed. Rep. of Germany

[21] Appl. No.: 362,409

[22] Filed: Mar. 26, 1982

[30] Foreign Application Priority Data

Apr. 9, 1981 [DE] Fed. Rep. of Germany ..... 3114331

[51] Int. Cl.[4] ..... A24F 5/32

[52] U.S. Cl. ..... 131/94; 131/282

[58] Field of Search ..... 131/282, 94, 283, 95

[56] References Cited

U.S. PATENT DOCUMENTS

| | | | |
|---|---|---|---|
| 4,196,740 | 4/1980 | Rudszinat | 131/282 |
| 4,483,349 | 11/1984 | Dyett et al. | 131/282 |
| 4,483,351 | 11/1984 | Seragnoli | 131/282 |

FOREIGN PATENT DOCUMENTS

| | | |
|---|---|---|
| 1007893 | 10/1965 | United Kingdom . |
| 1024102 | 3/1966 | United Kingdom . |
| 1499881 | 2/1978 | United Kingdom . |

*Primary Examiner*—V. Millin
*Assistant Examiner*—Greg Beaucage
*Attorney, Agent, or Firm*—Peter K. Kontler

[57] ABSTRACT

Filter cigarettes which are produced in a filter tipping machine are transported by a severing conveyor in the form of two rows wherein the filters of cigarettes in one row are adjacent to the filters of cigarettes in the other row. The cigarettes of the one row are thereupon inverted end-for-end by sets of pairwise arranged pivotable levers one of which withdraws a cigarette from the one row during movement along an endless circular path and turns the removed cigarette through 90 degrees about an axis which is normal to the cigarette and is remote from its filter while the one lever travels along an arc of 180 degrees. The thus partially inverted cigarette is taken over by the other lever of the respective pair and is turned through additional 90 degrees while the other lever travels along an arc of 180 degrees. The thus inverted cigarettes of the one row are thereupon shuffled with the non-inverted cigarettes of the other row by moving the two rows of cigarettes axially toward each other on two shuffling drums so that the two rows are converted into a single third row which is ready for testing and transport to storage or packing.

16 Claims, 4 Drawing Figures

APPARATUS FOR TIP TURNING FILTER CIGARETTES OR THE LIKE

BACKGROUND OF THE INVENTION

The present invention relates to treatment of filter cigarettes, cigars, cigarillos and analogous rod-shaped smokers' articles which are provided with filter plugs or mouthpieces (hereinafter called filters for short) at one of their ends. More particularly, the invention relates to improvements in so-called tip turning of filter cigarettes or analogous smokers' articles (hereinafter called cigarettes for short). Tip turning involves inversion of a series of cigarettes in a filter tipping or an analogous machine wherein two parallel rows of cigarettes are transported in such a way that their filters are adjacent to one another.

Filter cigarettes are normally produced in a machine which places filter plugs of double unit length between pairs of filter cigarettes of unit length and thereupon drapes an adhesive-coated uniting band around each of the thus obtained groups in such a way that the uniting band surrounds the filter plug and the adjacent portions of the corresponding plain cigarettes. The resulting filter cigarettes of double unit length are severed midway across their filter plugs so that each filter cigarette of double unit length yields two filter cigarettes of unit length and the filters of cigarettes in one of the thus obtained rows are adjacent to the filters of cigarettes in the other row. The cigarettes of one row must be inverted or tip turned end-for-end in order to ensure that the filters of all cigarettes will face in the same direction during further processing, such as testing, segregation of defective cigarettes from satisfactory cigarettes, transport to storage, or transport into a packing machine.

Heretofore known tip turning apparatus for use in or with filter tipping machines normally include rotary turntables or sets of orbiting arms (see commonly owned U.S. Pat. No. 3,583,546 granted June 8, 1971 to Gerhard Koop) which accept the cigarettes of one row, turn them through 180 degrees, and place them between the non-inverted cigarettes of the other row. This results in the formation of a single third row wherein the orientation of all filters is the same, i.e., the filters of the single third row of cigarettes are disposed one behind the other and the tobacco-containing ends of all cigarettes are also disposed one behind the other. A drawback of heretofore known tip turning apparatus is that they subject the cigarettes to a relatively rough treatment which entails deformation and/or escape of tobacco particles at those ends which are remote from the filters. Furthermore, presently known tip turning apparatus are incapable of properly inverting cigarettes at the rate they are produced in a modern high-speed filter tipping machine. Still further, such conventional apparatus are actually likely to promote the escape of tobacco particles at those ends which are remote from the filters, primarily under the action of highly pronounced centrifugal forces which invariably develop during mass-production of filter cigarettes or the like in known filter tipping machines.

OBJECTS AND SUMMARY OF THE INVENTION

An object of the invention is to provide an apparatus which can treat the articles gently, which occupies little room in a filter tipping or like machine, which can tip turn the articles at a speed that is needed in the latest versions of filter tipping and like machines, and which is less likely to cause escape of tobacco at the ends of cigarettes than heretofore known tip turning apparatus.

A further object of the invention is to provide the apparatus with novel and improved means for tip turning successive cigarettes of one of two rows of cigarettes wherein the filters of cigarettes in the one row are adjacent to the filters of cigarettes in the other row.

An additional object of the invention is to provide the apparatus with novel and improved means for shuffling the inverted and non-inverted articles to form a single third row of articles wherein all of the filters are oriented in the desired way for further processing.

Another object of the invention is to provide the apparatus with novel and improved means for counteracting the tendency of centrifugal force to cause escape of tobacco particles from filter cigarettes during tip turning.

A further object of the invention is to provide an apparatus which can be readily installed in or otherwise combined or associated with existing filter tipping or analogous machines for tip turning of one row of two neighboring rows of filter cigarettes, cigars, cigarillos or analogous rod-shaped smokers' articles.

An additional object of the invention is to provide the apparatus with novel and improved means for tip turning filter cigarettes or the like in several stages but nevertheless at a rate which cannot be achieved in conventional tip turning apparatus without risking ejection of articles, escape of tobacco from the tobacco-containing ends and/or deformation and/or other damage to the filters and/or tobacco-containing parts.

The invention resides in the provision of an apparatus for inverting filter cigarettes or analogous rod-shaped articles each of which has a simple or a composite filter at one of its end. The apparatus comprises means for transporting two parallel rows of articles sideways so that the filters of articles in one of the rows are adjacent to the filters of articles in the other row, means for turning the articles of the one row through at least substantially 180 degrees about axes which are at least substantially normal to the longitudinal directions of the articles of the one row and which are remote from the respective filters so that the filters of the thus inverted articles face away from the articles of the other row, and means for shuffling the two rows to form a single third row of articles wherein the orientation of all filters is the same. The shuffling means comprises means for moving the articles of at least one of the two rows lengthwise toward the other of the two rows.

The turning means preferably comprises means for conveying the articles of the one row along an endless path, means for turning successive articles of the one row through a first angle during transport along a first portion of the endless path, and means for turning successive articles of the one row through a secong angle during transport along a second portion of the endless path. The sum of the first and second angles equals or approximates 180 degrees, and the first angle preferably equals the second angle. The endless path can constitute a circular path, and each of the aforementioned portions of such path can extend along an arc of 180 degrees.

The turning means can further comprise a first mobile support (e.g., a pivotable lever with an article-receiving flute) for successive articles of the one row during turning through the first angle, and a second mobile support (e.g., a second pivotable lever with an article-receiving flute) for successive articles of the one row during turning through the second angle. Still further, the turning means can comprise means for attracting the articles to their supports by suction during turning through the first and second angles.

The transporting means can comprise means for advancing the articles of the two rows along a first path and the turning means can include means for conveying the articles of the one row along a second path (such as the aforementioned endless path). The aparatus then further comprises means for returning the inverted articles of the one row from the second into the first path prior to the shuffling step. The returning means can include means for establishing between the inverted articles of the one row and the non-inverted articles of the other row a distance which at least approximates the length of an article.

The shuffling means can include means for temporarily transporting the inverted articles of the one row and the non-inverted articles of the other row along separate paths.

As mentioned above, the returning means (or the turning means) can comprise means for establishing between the inverted articles of the one row and the non-inverted articles of the other row a distance which at least approximates the length of a single article. The shuffling means then comprises means for shifting the articles of the one row lengthwise through a distance $d_1$ in a direction toward the other row and means for shifting the articles of the other row lengthwise through a distance $d_2$ in a direction toward the articles of the one row. The distances $d_1$ and $d_2$ together equal or approximate twice the length of a single article, and the distance $d_1$ preferably equals or approximates the distance $d_2$. The result of such shuffling operation is that the articles of the single third row are aligned with and disposed one behind the other. In accordance with the presently preferred embodiment of the apparatus, the shuffling means includes means for alternately shifting the articles of the one and the other row so that the third row contains alternating articles of the one and the other row.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
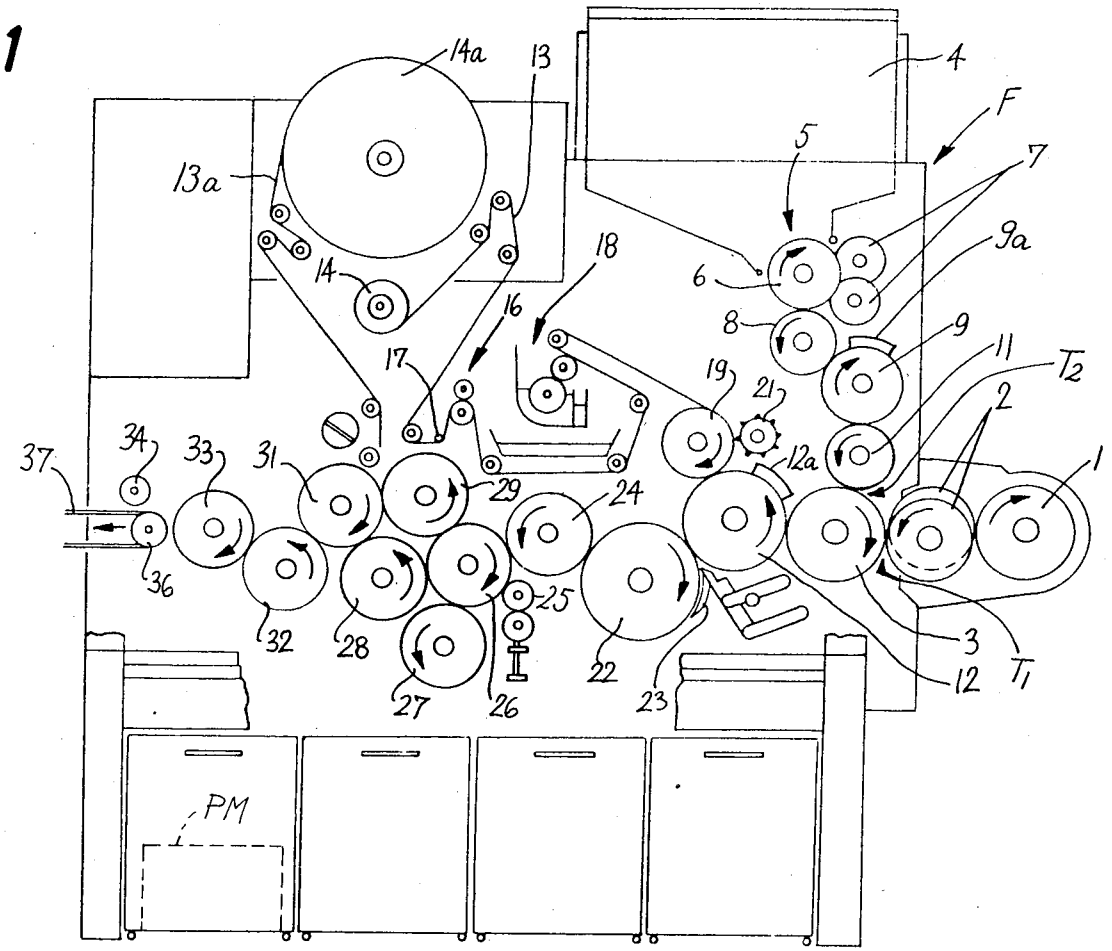
FIG. 1 is a somewhat schematic front elevational view of a filter tipping machine embodying a tip turning apparatus which is constructed and assembled in accordance with the present invention.

FIG. 1 shows a filter tipping machine of the type known as MAX S. Such machine is manufactured and sold by the assignee of the present invention and is directly or indirectly coupled to a cigarette maker, e.g., a machine known as GARANT or PROTOS each of which is manufactured and sold by the assignee of the present application. The cigarette maker turns out plain cigarettes of unit length which are delivered to the axially parallel peripheral flutes of a rotary drum-shaped conveyor 1 in such a way that each flute receives a single plain cigarette and the cigarettes in neighboring flutes are staggered relative to each other to form two rows one of which is nearer to one axial end and the other of which is nearer to the other axial end of the conveyor 1. The latter delivers the two rows of plain cigarettes to two discrete rotary drum-shaped aligning conveyors 2 which are also provided with peripheral flutes and are driven at different peripheral speeds and/or transport the plain cigarettes of the respective rows through different distances so that they deliver pairs of coaxial but spaced-apart plain cigarettes into successive flutes of a rotary drum-shaped assembly conveyor 3. Such delivery takes place at a first transfer station T1.

The conveyors 1 and 2 are mounted in the frame F of the filter tipping machine which supports a magazine 4 for a supply of parallel filter rod sections of six times unit length. Such filter rod sections extend at right angles to the plane of FIG. 1, the same as the plain cigarettes in the flutes of the conveyors 1 and 2, and descend through the outlet 5 of the magazine 4 into successive axially parallel peripheral flutes of a rotary drum-shaped cutting conveyor 6 cooperating with two rotary disc-shaped knives 7 to subdivide each filter rod section of six times unit length into three coaxial filter plugs of double unit length. The thus obtained sets of three coaxial filter plugs each are transferred onto a rotary staggering conveyor 8 which staggers the originally coaxial filter plugs of each set, as considered in the circumferential direction of the components of the conveyor 8, and delivers successive individual filter plugs into successive peripheral flutes of a rotary drum-shaped shuffling conveyor 9. The latter cooperates with one or two stationary cams **9*a* to shift some or all of the filter plugs axially and to thus convert the series of staggered filter plugs into a single row wherein each preceding filter plug is in exact alignment with the next-following filter plug. Successive filter plugs of such single row are transferred, by a rotary drum-shaped accelerating and inserting conveyor 11, into successive flutes of the assembly conveyor 3 (at a second transfer station T2) in such positions that they are received in the spaces between successive pairs of plain cigarettes which are delivered by the aligning conveyors 2 at the transfer station T1. Thus, each such flute of the assembly conveyor 3 which advances beyond the transfer station T1 contains a group of three coaxial rod-shaped articles (namely, two coaxial but spaced-apart plain cigarettes of unit length and a filter plug of double unit length therebetween), and such groups are transferred into successive axially parallel peripheral flutes of a rotary drum-shaped conveyor 12 cooperating with one or two stationary condensing cams 12*a*** which ensure that one or both plain cigarettes of each group are shifted axially toward the respective filter plug in order to eliminate clearances, if any, between the two end faces of the filter plugs and the adjacent cigarettes.

The frame F of the filter tipping machine further supports an expiring reel 14 consisting of a convoluted web 13 of tipping paper (such as cigarette paper or artificial cork) which is drawn by two advancing rolls 16 at least one of whieh is driven to move successive increments of the running web 13 past the relatively sharp edge of a curling device 17 of the type disclosed in commonly owned U.S. Pat. No. 3,962,957 granted June 15, 1976 to Alfred Hinzmann. A fresh reel 14*a* is held in a position of readiness so that the leader of its web 13*a* can be spliced to the running web 13 shortly prior to expiration of the supply of tipping paper on the core of the reel 14. A splicing device which can be used in the machine of FIG. 1 is disclosed in commonly owned U.S. Pat. No. 3,730,811 granted May 1, 1973 to Gerd-Joachim Wendt.

The running web 13 advances beyond the nip of the rolls 16 and one of its sides is coated with a layer of suitable adhesive during travel along a paster 18. The leader of the web 13 adheres to the peripheral surface of a rotary suction drum 19 which cooperates with the knives of a cutting drum 21 to subdivide the leader of the web 13 into discrete uniting bands. Such bands are attached to successive groups of coaxial articles on the transfer conveyor 12 so that each uniting band adheres to the corresponding filter plug as well as to the adjacent end portions of the respective plain cigarettes.

Successive groups, each of which carries an adhesive-coated uniting band, are thereupon transferred onto a rotary drum-shaped draping conveyor 22 which cooperates with a stationary or mobile rolling device 23 (e.g., a device of the type disclosed in commonly owned U.S. Pat. Nos. 3,483,873 and 3,527,234 both granted to Alfred Hinzmann on Dec. 16, 1969 and Sept. 8, 1970, respectively) to convolute successive uniting bands around the corresponding groups so that each such group is converted into a filter cigarette of double unit length. Successive filter cigarettes of double unit length are transferred onto a rotary drum-shaped drying or heating conveyor 24 which promotes the setting of adhesive at the inner sides of convoluted uniting bands before the filter cigarettes are transferred onto a rotary drum-shaped severing conveyor 26 which constitutes one component of the improved tip turning apparatus and cooperates with a rotary disc-shaped knife 25 to subdivide each filter cigarette of double unit length into two filter cigarettes of unit length. The severing plane extends midway across the filter plugs of successive filter cigarettes of double unit length so that the single row of filter cigarettes of double unit length is converted into two parallel rows of filter cigarettes of unit length whereby the filter plugs of filter cigarettes in one of the two rows are adjacent to the filter plugs of cigarettes in the other of the two rows. The severing conveyor 26 transports the cigarettes of the two rows sideways (i.e., at right angles to the axes of such cigarettes) and in the direction indicated by the arrow. At the same time, the severing conveyor 26 includes, constitutes or cooperates with means for segregating defective filter cigarettes of double unit length or unit length from satisfactory cigarettes, e.g., by permitting filter cigarettes without plain cigarettes or without filter plugs to descend by gravity into a suitable collecting receptacle, not shown.

The tip turning apparatus in the filter tipping machine of FIG. 1 further comprises a turning unit including a rotary drum-shaped conveyor 27 which receives one of the two rows of filter cigarettes of unit length and inverts successive filter cigarettes of the one row during transport to one of two rotary drum-shaped conveyors 28, 29 forming part of a cigarette shuffling unit in the tip turning apparatus. The conveyor 28 receives inverted filter cigarettes by way of the severing conveyor 26, i.e., the conveyor 27 returns the inverted filter cigarettes to the conveyor 26 which, in turn, delivers such cigarettes to the conveyor 28. The conveyor 29 receives the non-inverted cigarettes of the other row directly from the severing conveyor 26, and the conveyors 28, 29 shift the respective cigarettes axially to form a single row wherein the filter plugs of all cigarettes face in the same direction. Such third row is formed on a rotary drum-shaped testing conveyor 31. The conveyor 31 cooperates with or comprises means for testing the quality of wrappers of successive filter cigarettes of unit length and delivers the satisfactory as well as the defective cigarettes to a second rotary drum-shaped testing conveyor 32 which cooperates with a nozzle or another ejector to segregate defective cigarettes from satisfactory cigarettes and is provided with means for testing the condition of tobacco-containing ends of successive filter cigarettes of unit length so that cigarettes whose ends are defective can be ejected at the locus of segregation of cigarettes having defective wrappers.

Satisfactory cigarettes advance beyond the testing conveyor 32 to a rotary drum-shaped transfer conveyor 33 (ejection of cigarettes having defective wrappers and/or defective tobacco-containing ends can take place on the conveyor 33). The conveyor 33 deposits satisfactory filter cigarettes of unit length onto the upper reach of a belt conveyor 37 which is trained over pulleys 36 (only one shown) and cooperates with a rotary drum-shaped braking conveyor 34. The upper reach of the conveyor 37 can deliver satisfactory cigarettes to storage, to a reservoir (e.g., of the type known as RESY and manufactured by the assignee of the present application) or directly to a packing machine, e.g., a machine known as COMPAS which is produced and sold by the assignee of the present application. A testing unit which can be used in the filter tipping machine of FIG. 1 is disclosed, for example, in the commonly owned U.S. Pat. No. 3,962,906 granted June 15, 1976 to Uwe Heitmann et al.

Figure 2:
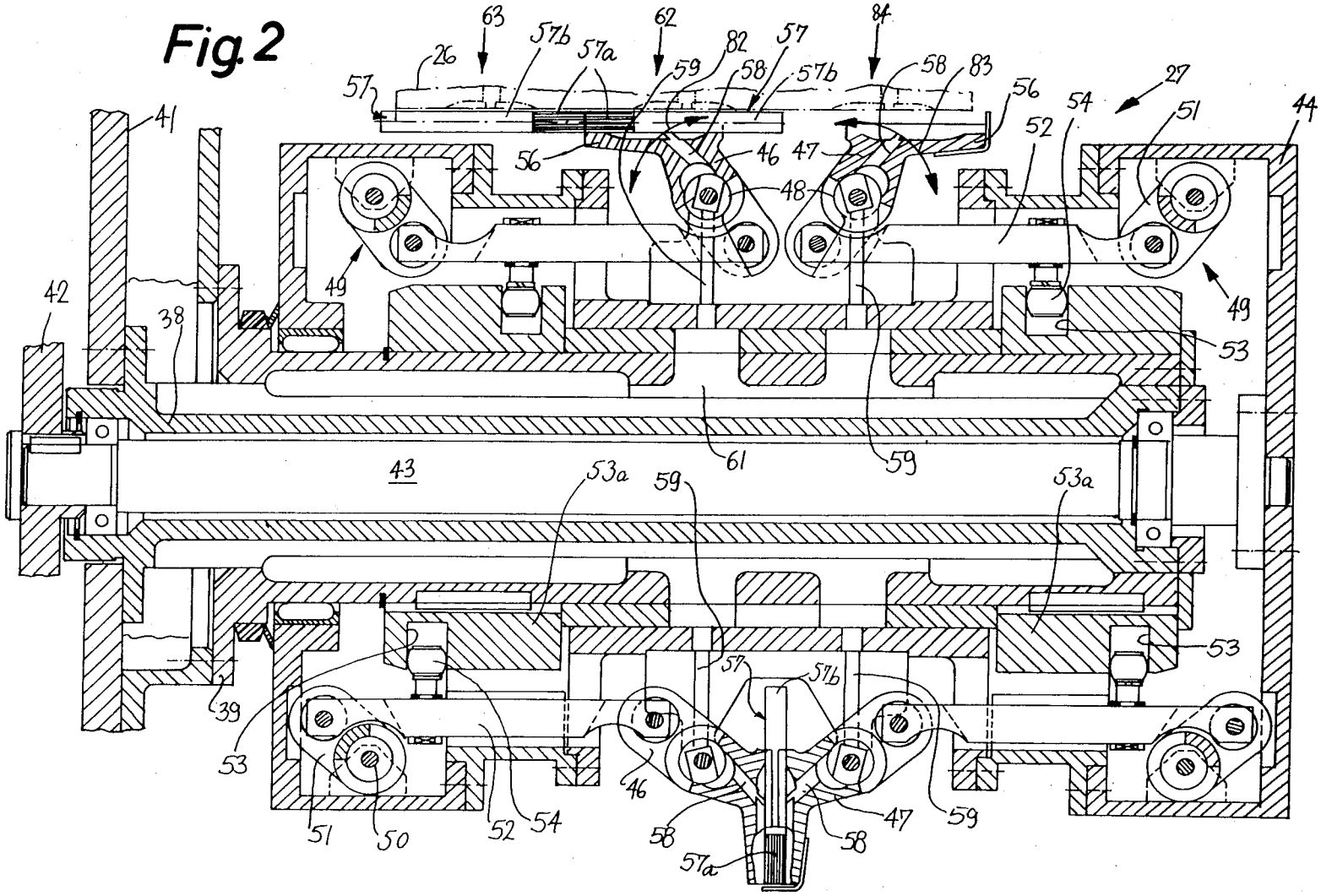
FIG. 2 is a greatly enlarged axial sectional view of the article turning unit in the tip turning apparatus of the machine shown in FIG. 1.

Referring now to FIG. 2, there is shown the turning unit including the conveyor 27. This conveyor is mounted on a stationary side wall 41 of the frame F of the filter tipping machine, and more particularly on a stationary horizontal hollow shaft 38 provided with a flange which is bolted to the wall 41. The hollow shaft 38 carries a stationary housing 39 which constitutes the stator of the conveyor 27. The reference character 44 denotes the rotor which is mounted on and rotates about the shaft 38. The means for transmitting torque from the main prime mover PM of the filter tipping machine shown in FIG. 1 to the rotor 44 comprises a horizontal shaft 43 which is journalled in the stationary shaft 38 and the right-hand end portion of which (as viewed in FIG. 2) is secured to the adjacent end wall of the rotor 44. The shaft 43 receives torque from a suitable transmission including a driver gear 42 which is shown in the left-hand portion of FIG. 2.

The rotor 44 constitutes a means for moving a plurality of pairwise arranged mobile holders or supports 46, 47 along an endless circular path extending about the stationary hollow shaft 38. Each of the holders or supports is a lever which is pivotably mounted on the support or rotor 44 by a pivot member 48 extending substantially tangentially of the rotor (namely, at right angles to the axes of filter cigarettes 57 of unit length which are transported by the severing conveyor 26). The left-hand lever 46 which is shown in the upper portion of FIG. 2 is pivotable between the illustrated first position in which its receiving means or flute 56 is substantially horizontal and adjacent to one row 62 of filter cigarettes 57 and a second position which is illustrated in the lower part of FIG. 2 and which the lever reaches after turning clockwise through an angle of 90 degrees about the respective pivot member 48. The other lever 47 is pivotable between a first position which shown in the upper portion of FIG. 2 and in which its receiving means or flute 56 is parallel with the flute 56 of the associated lever 46 and a second position which is shown in the lower part of FIG. 2 and in which the flutes 56 of the two levers 46, 47 are adjacent to each other and extend substantially radially of the rotor 44. In their first positions, the flutes 56 of the levers 46, 47 are parallel to the axis of the rotor 44 and are adjacent to the transfer station between the conveyor 26 and the conveyor 27 of the turning unit. It will be noted that the levers 47 are remote from the row 63 of non-inverted filter cigarettes 57.

The levers 46, 47 of each pair cooperate to turn the filter cigarettes 57 of the row 62 about axes which are normal to the longitudinal directions of such cigarettes and are remote from the filter tips 57*a* of the respective cigarettes. In other words, such axes are adjacent to the tobacco-containing ends of the respective cigarettes 57, namely, to the free ends of the tobacco containing portions 57*b* of the cigarettes 57. The position of a freshly inverted filter cigarette 57 on the corresponding lever 47 is shown in the upper right-hand portion of FIG. 2. Such inverted cigarette is aligned with a cigarette of the row 63 of non-inverted cigarettes but is spaced apart therefrom, as considered in the axial direction of such cigarettes. The filter plug 57*a* of the inverted cigarette is remote from the corresponding non-inverted cigarette 57 of the row 63, i.e., the filter plug 57*a* of the inverted cigarette is separated from the aligned non-inverted cigarette by the tobacco containing portion 57*b* of the inverted cigarette plus a gap having a width corresponding to the length of a filter cigarette 57 of unit length.

The means for pivoting the levers 46, 47 of each pair in opposite directions (the directions in which the levers 46, 47 are pivotable between their first and second positions are respectively indicated by double-headed arrows 82 and 83 shown in the upper portion of FIG. 2) comprises a first link 52 which is articulately connected with the lever 46 or 47, a relatively short second link 51 which is articulately connected with the associated link 52 and is pivotably mounted in the rotor 44, as at 50, a roller follower 54 which is mounted on the link 52, and a stationary cam 53*a* having a substantially spiral-shaped endless groove 53. The cam 53*a* is mounted on or forms part of the housing 39. FIG. 2 shows that the turning unit including the conveyor 27 comprises two cams 53*a* each of which has an endless groove 53, such grooves being mirror symmetrical to one another with reference to a plane which is normal to the shaft 43 and extends midway between the two pairs of pivot members 48. The link trains 49, each of which includes two links 51, 52 and a roller follower 54, rotate with the rotor 44 relative to the respective stationary cams 53*a*.

The means for attracting filter cigarettes 57 to the retaining means or flutes 56 of the levers 46 and 47 comprises suction ports 58 which are machined into the levers and communicate with the respective flutes 56, and suction channels 59 which are machined into the levers 46, 47 and communicate with the respective ports 58 as well as with a stationary suction chamber 61 which is disposed between the hollow shaft 38 and the housing 39 of the conveyor 27.

Figure 4:
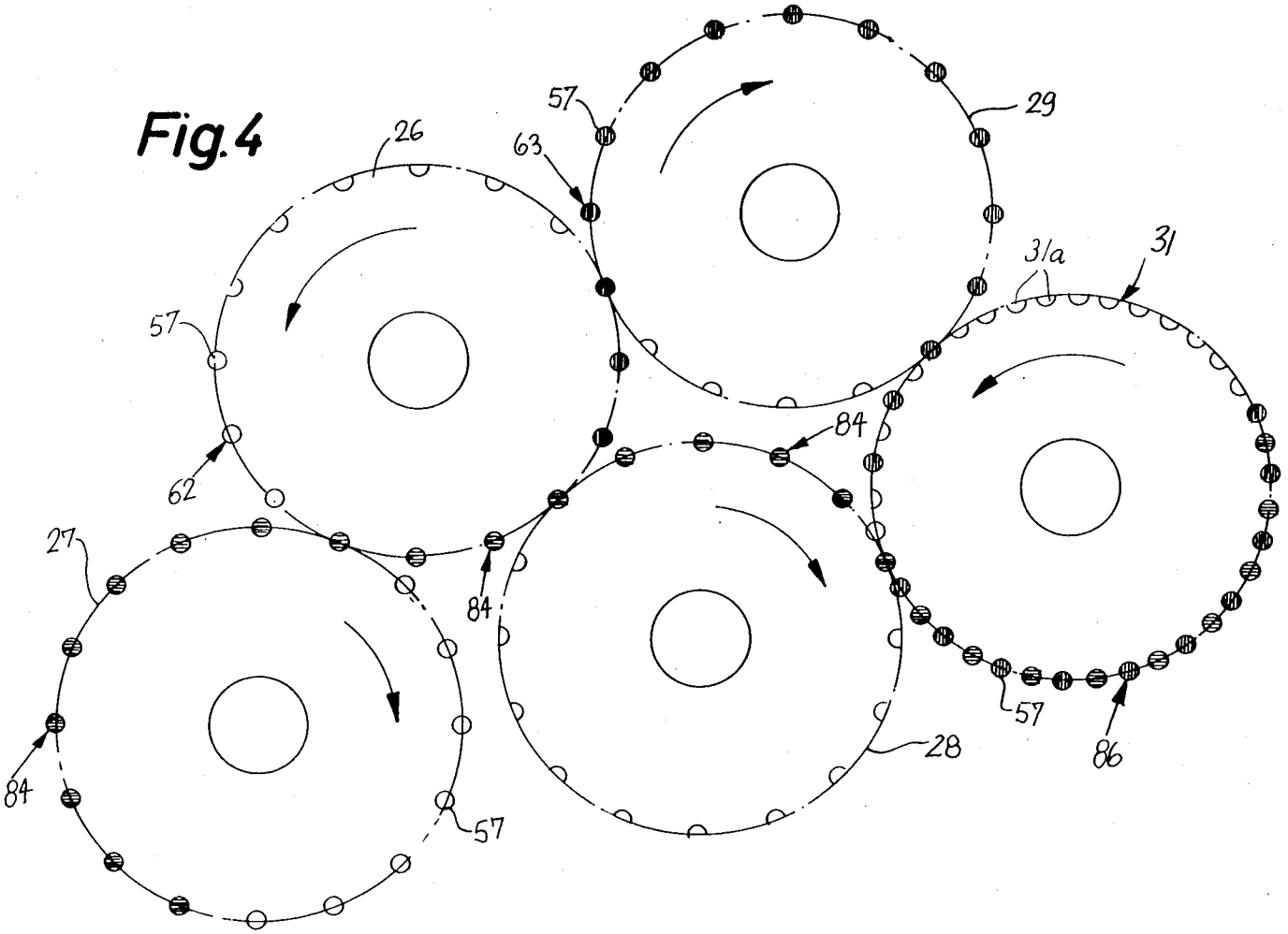
FIG. 4 is an end elevational view of the tip turning apparatus showing a severing conveyor which transports two rows of articles into the range of the tip turning unit, the tip turning unit, the two conveyors of the shuffling unit, and a conveyor which receives and removes the third row of articles.

As shown in FIGS. 1, 2 and 4, the tip turning apparatus is mounted in the frame F in such a way that the severing conveyor 26 is located at a level above the rotor 44 of the conveyor 27. Therefore, successive pairs of levers 46, 47 invert successive filter cigarettes 57 of the row 62 during travel of such cigarettes along a circular path about the axis of the stationary shaft 38 in such a way that the filter cigarette 57 which is engaged and attracted by a lever 46 is turned with this lever through 90 degrees while the corresponding lever 46 travels along an arc of 180 degrees. The partially inverted cigarette 57 is then accepted by the associated lever 47 which assumes the position shown in the lower part of FIG. 2, and the lever 47 then completes the inversion by turning the cigarette 57 through another 90 degrees during travel along an arc of 180 degrees to the position shown in the upper part of FIG. 2. In such position, the lever 47 admits the inverted cigarette 57 into the adjacent (oncoming) flute of the severing conveyor 26. In other words, the conveyor 26 defines a first path which is common to the rows 62, 63, the rotor 44 of the conveyor 27 defines an endless second path along which the cigarettes 57 of the row 62 travel during inversion, and the row 84 of inverted cigarettes 57 is returned into the first path which is defined by the severing conveyor 26.

Figure 3:
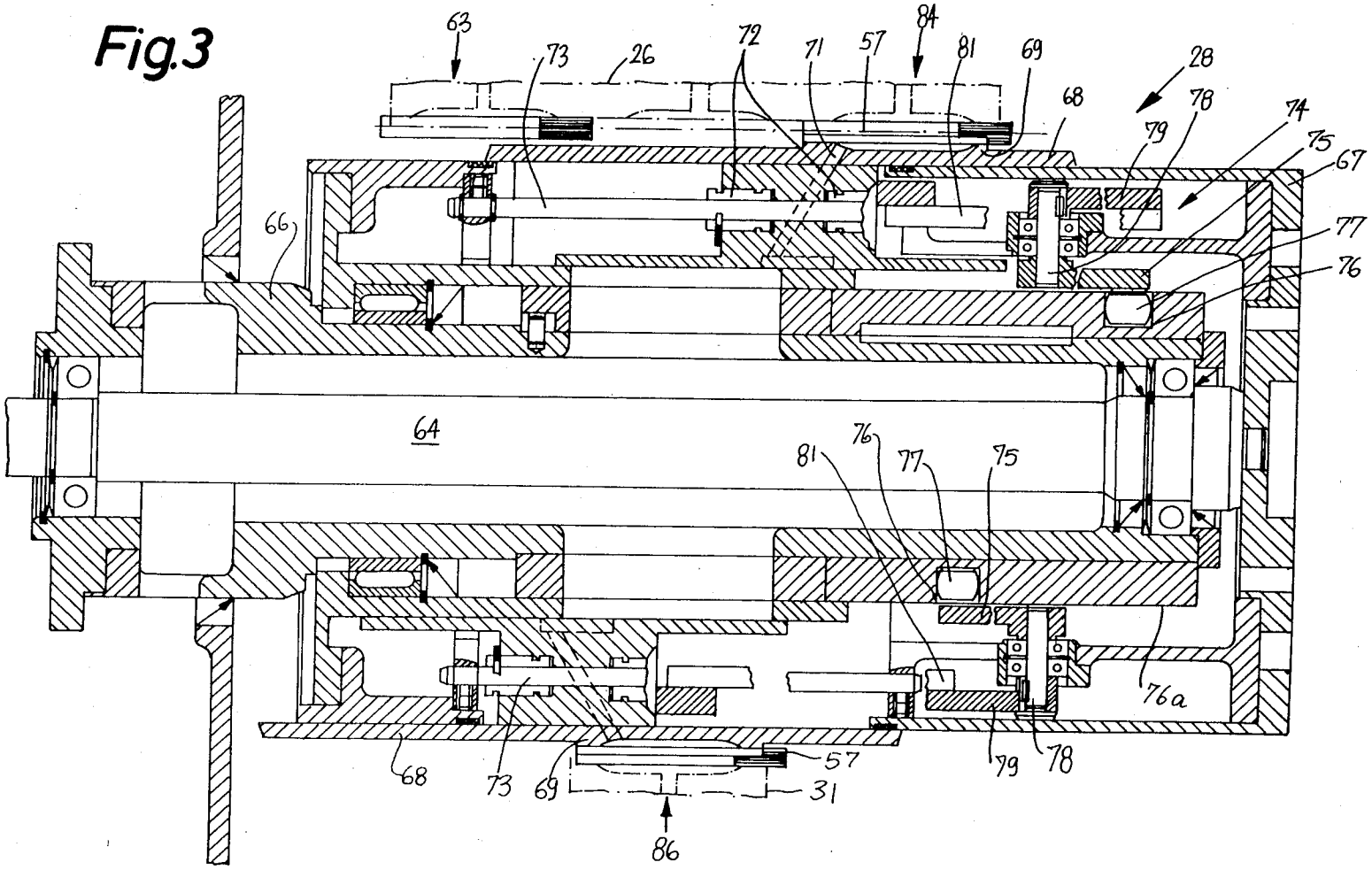
FIG. 3 is a greatly enlarged axial sectional view of one conveyor of the shuffling unit in the tip turning apparatus of the machine shown in FIG. 1.

FIG. 3 illustrates one of the two conveyors forming part of the shuffling unit in the improved tip turning apparatus. More specifically, FIG. 3 shows the details of the shuffling conveyor 28 which is preferably identical with the shuffling conveyor 29. Therefore, the details of the shuffling conveyor 29 are not specifically shown in the drawing. The shuffling conveyor 29 transports the row 63 of non-inverted filter cigarettes 57 from the conveyor 26 to the testing conveyor 31 of FIG. 1. On the other hand, the shuffling conveyor 28 transports the row 84 of inverted filter cigarettes 57 (previously the row 62 shown in FIG. 2) from the conveyor 26 to the conveyor 31.

The shuffling conveyor 28 comprises a driver shaft 64 which is surrounded by a stationary housing or hub 66 and is connected with a rotor 67. The latter is rotatable on the stationary housing 66 and supports several carriages 68 each one or several article receiving flutes having an article receiving flute 69 extending in parallelism with the axis of the driver shaft 64. The flutes 69 of the carriages 68 communicate with suction ports 71 which attract filter cigarettes 57 of the row 84 during axial movement of such cigarettes in parallelism with the axis of the shaft 64.

The rotor 67 supports several elongated guide rods 73 which are parallel to the shaft 64 and slidably support the respective carriages 68. To this end, the carriages 68 are provided with pairs of suitable spherical or otherwise configurated bearings 72 to reduce friction during frequent back-and-forth movements in directions to the left and to the right, as viewed in FIG. 3. The means 74 for reciprocating the carriages 68 along the respective guide rods 73 comprises roller followers 77 which extend into a suitably configurated endless groove 76 provided in a stationary cam 76*a* which is secured to the housing 66. The roller followers 77 are mounted on levers 75 which, in turn, are attached to radially extending shafts 78 mounted in the rotor 67. Each shaft 78 further carries a lever 79 which is articulately having one or several article receiving flutes 69 extending in parallelism.

The operation from the tip turning apparatus is as follows:

The severing conveyor 26 transports the two rows 62 and 63 of filter cigarettes 57 of unit length along a first path and delivers the cigarettes of the row 63, in non-inverted condition, to the shuffling conveyor 29. Successive filter cigarettes 57 of the row 62 are accepted by successive levers 46 of the turning unit including the conveyor 27, and such levers thereupon perform pivotal movements, as described in connection with FIG. 2, prior to delivery of partially inverted cigarettes 57 into the flutes 56 of the associated levers 47. The levers 47 thereupon complete the inversion of cigarettes 57 and deliver the inverted cigarettes into the oncoming flutes of the severing conveyor 26 at the same station at which successive levers 46 receive cigarettes 57 of the row 62. This is shown in the upper portion of FIG. 2. The row 84 of inverted cigarettes 57 is transported by the severing conveyor 26 which delivers such cigarettes into successive flutes of the shuffling conveyor 28, namely into the flutes 69 of successive carriages 68 on the rotor 67 of the shuffling conveyor 28.

Referring to FIG. 4, the non-inverted cigarettes 57 of the row 62 on the severing conveyor 26 are designated by circles. The inverted cigarettes 57 of the row 84 are indicated by horizontal hatching. Such inversion takes place on the rotor 44 of the conveyor 27. The regulation of suction in the ports 58 of the levers 46 and 47 on the rotor 44 is such that a lever 46 attracts a filter cigarette 57 during transport along an arc of 180 degrees from the position shown in the upper part to the position shown in the lower part of FIG. 2. The suction chamber 61 is then disconnected from the ports 58 of such lever 46 and, at the same time, the ports 58 of the associated lever 47 begin to communicate with the suction chamber 61 so that the partially inverted cigarette 57 is automatically transferred into the flute 56 of the lever 47 which thereupon proceeds with the second stage of inversion of the cigarette 57 through 180 degrees and delivers the inverted cigarette into an oncoming flute of the severing conveyor 26. The two cams 53*a* on the stationary housing 39 of the turning unit including the conveyor 27 cooperate to ensure that the levers 46, 47 of each pair are pivoted in synchronism but always in opposite directions. Thus, the lever 46 which is shown in the upper part of FIG. 2 begins to pivot clockwise to the position shown in the lower portion of FIG. 2, and such lever thereupon begins to pivot in the opposite direction to return to the first position shown in the upper part of FIG. 2. At the same time, the associated lever 47 first pivots in a counterclockwise direction from the position shown in the upper part to the position shown in the lower part of FIG. 2, and thereupon in a clockwise direction to return from the second position to the first position of FIG. 2. As mentioned above, the mode of pivoting each cigarette 57 of the row 62 is such that the filter 57*a* is located outwardly of the respective tobacco-containing portion 57*b*. This ensures that the cigarettes 57 do not lose tobacco particles during inversion on the turning unit. The lower part of FIG. 2 shows that the filter 57*a* is located radially outwardly of the tobacco containing portion 57*b* of the partially inverted filter cigarette 57 between the respective levers 46 and 47. The flutes 56 of the levers 46 are empty during movement with the rotor 44 from the positions corresponding to that of the lower lever 46 of FIG. 2 to that of the upper lever 46 in FIG. 2. Inversely, the flutes of the levers 47 carry filter cigarettes 57 during travel from the lower part to the upper part of the FIG. 2. As mentioned above, a lever 46 receives a cigarette 57 of the row 62 while the associated lever 47 delivers a freshly inverted cigarette 57 to the severing conveyor 26.

In FIG. 4, the cigarettes of the row 63 are denoted by vertical hatching. Such cigarettes advance from the severing conveyor 26 onto the second shuffling conveyor 29, where they are shifted axially in the same way as the cigarettes on the shuffling conveyor 28, and the thus axially displaced cigarettes 57 of the row 63 are thereupon deposited in the oncoming flutes 31*a* of the testing conveyor 31. The arrangement is such that the cigarettes of the row 84 which is supplied by the shuffling conveyor 28 alternate with the cigarettes of the row 63 to form therewith a single row 86 of alternating inverted and noninverted cigarettes 57. The cigarettes of the row 86 are tested and are thereupon delivered to the rotary drum-shaped testing conveyor 32 shown in FIG. 1.

In FIG. 4, the row 62 of filter cigarettes 57 is located in front of the row 63. The shuffling conveyors 28 and 29 preferably shift the cigarettes of the rows 84 and 63 through identical distances but in opposite directions, namely, toward each other so that the cigarettes of the single row 86 are accurately aligned with each other and the non-inverted cigarettes of the row 63 alternate with the inverted cigarettes of the row 84. The axes of the conveyors 26, 27, 28, 29, 31 are parallel to each other.

The filter cigarettes 57 of the row 63 on the shuffling conveyor 29 are moved axially toward the observer of FIG. 4. On the other hand, the filter cigarette 57 of the row 84 on the shuffling conveyor 28 are moved away from the observer. Each of the filter cigarettes on the conveyor 29 is moved through a distance which corresponds to or equals the length of a filter cigarette 57. The same holds true for the filter cigarettes 57 of the row 84 on the shuffling conveyor 28. This ensures that each filter cigarette 57 on the testing conveyor 31 is accurately aligned with a filter cigarette 57 which follows or which precedes such cigarette.

Referring now to the mode of operation of the shuffling conveyor 28 shown in FIG. 3, the flutes 69 of successive carriages 68 accept cigarettes 57 of the row 84 from the severing conveyor 26 and the cigarettes are attracted by suction which is applied via ports 71. As the rotor 67 turns about the axis of the shaft 64, the roller followers 77 travel in the groove 76 of the cam 76*a* and shift the corresponding carriages 68 axially in a direction to the left, as viewed in FIG. 3, until the transport of the corresponding filter cigaretter 57 through a distance corresponding to the length of such cigarette is completed. The corresponding suction ports 71 are then disconnected from the associated suction chamber (not shown), and the axially shifted filter cigarette 57 is attracted to the testing conveyor 31 whose flutes 31*a* are also in communication with suction ports, not specifically shown in FIGS. 1 or 4. The empty carriage 68 thereupon returns to the position shown in the upper portion of FIG. 3 to accept an inverted cigarette 57 of the row 84. The throws of the levers 75 and 79 can be readily selected in such a way that each carriage 68 transports the cigarette 57 in its flute 69 through a desired or selected distance, such as the aforementioned length of a single filter cigarette 57. The position of a cigarette 57 which has been shifted through a distance corresponding to its length is shown in the lowerr part of FIG. 3. This lower part of FIG. 3 futher shows a portion of the testing conveyor 31 which accumulates the row 86 for testing and transport to the conveyor 32. The carriages of the shuffling conveyor 29 move in a direction to the right, as viewed in FIG. 3, namely, toward the observer of FIG. 4, during transfer or axial shifting of cigarettes 57 which form the row 63 and are to be transferred onto the conveyor 31 to form part of the row 86. It will be noted that the spacing between neighboring flutes 31*a* on the testing conveyor 31 is different from the spacing of flutes on successive carriages of the shuffling conveyors 28 and 29. This is necessary in order to ensure that alternating flutes 31*a* receive non-inverted filter cigarettes 57 of the row 63 and that the remaining flutes 31*a* receive inverted cigarettes 57 of the row 84. In the illustrated embodiment, the spacing between the centers of two neighboring flutes 31 is half the spacing between the centers of flutes on neighboring carriages which are mounted on the rotors of the shuffling conveyors 28 and 29.

The feature that the conveyor 27 returns the inverted cigarettes 57 (row 84) onto the severing conveyor 26 is desirable and advantageous because this eliminates the need for an additional conveyor. The levers 46, 47 could be mounted on a different conveyor; however, a rotary conveyor with a rotor (44) whose periphery supports several pairs of cooperating levers 46, 47 has been found to contribute to simplicity and compactness of the turning unit.

The shuffling unit could be modified by omitting one of the conveyors 28, 29 and by designing the carriages 68 on the remaining shuffling conveyor in such a way that each carriage would move a filter cigarette 57 axially through a distance corresponding to that of a filter cigarette of double unit length. The solution which is shown in the drawing and which employs two shuffling conveyors is preferred at this time because the intervals of time which are needed to shift the cigarettes of the rows 63 and 84 axially (through distances corresponding to the length of a single cigarette 57) are shorter.

An important advantage of the improved apparatus is that pronounced centrifugal forces which develop during tip turning of cigarettes 57 on the turning unit including the conveyor 27 of FIG. 2 cannot cause any escape of tobacco particles from the tobacco containing portions 57*b* of such cigarettes. The centrifugal forces are active upon the filter tips 57*a* which do not contain any loose particles so that the action of such centrifugal forces on the filter plugs does not entail any damage to the cigarettes 57. The tobacco containing ends of cigarettes 57 face inwardly (see the lower part of FIG. 2) so that the centrifugal forces cannot effect any disloading or expulsion of tobacco particles therefrom. Furthermore, the length of flutes 56 on the levers 46 and 47 and the number of suction ports 58 in the levers can be readily selected in such a way that the wrappers of the cigarettes 57 are held gently but firmly during tip turning so that the cigarettes do not charge their axial positions during transfer from the conveyor 26, around the axis of the stationary shaft 38 and back to the conveyor 26.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for inverting filter cigarettes or analogous rod-shaped articles each of which has a filter at one end thereof, comprising means for transporting two parallel rows of articles sideways along a first path so that the filters of articles in one of said rows are adjacent to the filters of articles in the other of said rows; means for turning the articles of said one row through at least substantially 180 degrees about axes which are at least substantially normal to the longitudinal directions of such articles and are remote from the respective filters so that the filters of the thus inverted articles face away from the articles of said other row, said turning means comprising at least one pair of holders each having article retaining means, means for moving said holders along a second path, and means for pivoting said holders relative to said moving means between first positions in which the receiving means of one of said holders is adjacent to the articles of one row in said first path and the other holder is remote from said first path, and second positions in which the article receiving means of said holders are adjacent to each other so that the receiving means of said one holder can accept an article of said one row from said first path in the first position of said one holder and such article can be transferred into the receiving means of said other holder in the second positions of said holders for pivotal movement with said other holder during pivoting of the latter to said first position thereof; and means for shuffling the articles of said rows to form a single third row of articles wherein the orientation of all filters is the same.

2. The apparatus of claim 1, wherein said second path is an endless path.

3. The apparatus of claim 2, wherein said endless path is a substantially circular path and the sum of pivotal movements of said holders between said first and second positions thereof at least approximates 180 degrees.

4. The apparatus of claim 1, wherein said moving means comprises a rotary support for said holders.

5. The apparatus of claim 4, wherein said holders are levers which are disposed at the periphery of said rotary support and said pivoting means comprises a linkage for each of said holders and cam and follower means for articulating said linkages.

6. The apparatus of claim 1, wherein said transporting means comprises a first conveyor arranged to transport said two rows of articles along said first path, said means for moving said holders comprising a second conveyor arranged to transport the articles of said one row along said second path and said shuffling means comprising at least one third conveyor arranged to move the articles of one of said two rows lengthwise toward the articles of the other of said two rows.

7. The apparatus of claim 6, wherein said second conveyor is a rotary conveyor.

8. The apparatus of claim 6, wherein said shuffling means comprises two third conveyors, one for each of said two rows of articles and each arranged to move the articles of the respective row lengthwise in a direction to convert the articles of said two rows into said single third row wherein successive articles are disposed one behind the other and are aligned with each other.

9. The apparatus of claim 8, wherein the inverted articles in said second path are spaced apart from the non-inverted articles of said other row by a distance which at least approximates the length of an article, said third conveyors being arranged to shift the respective articles through distances each of which at least approximates the length of an article.

10. The apparatus of claim 8, wherein said third conveyors are arranged to shift the inverted articles of said one row and the non-inverted articles of said other row in alternating sequence so that said third row contains alternating inverted and non-inverted articles.

11. The apparatus of claim 6, wherein said first conveyor constitutes a severing conveyor of a filter tipping machine.

12. The apparatus of claim 11, wherein said first conveyor is a rotary drum.

13. The apparatus of claim 1, wherein said shuffling means comprises at least one rotary conveyor and at least one carriage provided on said rotary conveyor, said carriage having article receiving means and being movable back and forth in parallelism with the axis of said rotary conveyor.

14. The apparatus of claim 13, wherein said shuffling means further comprises means for moving said carriage back and forth.

15. The apparatus of claim 1, wherrein the means for moving said carriage comprises a stationary cam and follower means operatively connected with said carriage and tracking said cam.

16. The apparatus of claim 1, wherein said transporting means comprises a first rotary conveyor, said means for moving said holders comprises a second rotary conveyor for the articles of said one row, and said shuffling means comprises at least one third rotary conveyor, said conveyors having parallel axes.

* * * * *